US008293034B2

(12) United States Patent
Wu et al.

(10) Patent No.: US 8,293,034 B2
(45) Date of Patent: Oct. 23, 2012

(54) LEAD-FREE BRASS ALLOY

(75) Inventors: Wei Te Wu, Taichung (TW); Wen Lin Lo, Taichung (TW); Keng J. Lin, Taichung County (TW); Hung C. Lu, Taoyuan County (TW)

(73) Assignee: Modern Islands Co., Ltd., Tortola (VG)

( * ) Notice: Subject to any disclaimer, the term of this patent is extended or adjusted under 35 U.S.C. 154(b) by 0 days.

(21) Appl. No.: 12/731,683

(22) Filed: Mar. 25, 2010

(65) Prior Publication Data

US 2011/0182768 A1 Jul. 28, 2011

(30) Foreign Application Priority Data

Jan. 22, 2010 (TW) ..... 99101732 A

(51) Int. Cl.
*C22C 9/04* (2006.01)

(52) U.S. Cl. ..... 148/434; 420/479

(58) Field of Classification Search ..... 148/434; 420/479

See application file for complete search history.

(56) References Cited

U.S. PATENT DOCUMENTS

| | | | |
|---|---|---|---|
| 5,330,712 | A | 7/1994 | Singh |
| 5,487,867 | A | 1/1996 | Singh |
| 5,637,160 | A | 6/1997 | Brock et al. |
| 5,653,827 | A | 8/1997 | Kramer et al. |
| 5,942,056 | A | 8/1999 | Singh |
| 6,149,739 | A | 11/2000 | Smith |
| 6,955,378 | B2 | 10/2005 | Schlack et al. |
| 6,974,509 | B2 | 12/2005 | Hagiwara et al. |
| 7,297,215 | B2 | 11/2007 | Kurose et al. |
| 7,354,489 | B2 | 4/2008 | Hofmann et al. |
| 2002/0069942 | A1 | 6/2002 | Oishi |
| 2004/0023441 | A1 | 2/2004 | Trivedi |
| 2004/0094243 | A1 | 5/2004 | Wynne et al. |
| 2006/0005901 | A1 | 1/2006 | Kurose et al. |
| 2006/0078458 | A1 | 4/2006 | Strobl et al. |
| 2007/0062615 | A1 | 3/2007 | Oishi |

FOREIGN PATENT DOCUMENTS

| | | | | |
|---|---|---|---|---|
| CN | 101440450 | A | | 7/2008 |
| CN | 101285137 | A | | 10/2008 |
| CN | 101285138 | A | | 10/2008 |
| CN | 101403056 | A | | 4/2009 |
| CN | 101440445 | A | | 5/2009 |
| JP | 2793041 | | * | 9/1998 |
| JP | 2004285449 | | * | 10/2004 |
| JP | 2008208466 | | * | 9/2008 |
| TW | 421674 | B | | 2/2001 |

* cited by examiner

*Primary Examiner* — Sikyin Ip

(74) *Attorney, Agent, or Firm* — Edwards Wildman Palmer LLP; Peter F. Corless

(57) ABSTRACT

The present invention provides a lead-free brass alloy, including 0.3 to 0.8 wt % of aluminum, 0.01 to 0.4 wt % of bismuth, 0.05 to 1.5 wt % of iron and more than 96 wt % of copper and zinc, wherein the copper is present in an amount ranging from 58 to 75 wt %. The brass alloy of the present invention meets the standard of the environmental regulation, wherein the lead content is less than 0.25 wt % based on the weight of the alloy. Further, the brass alloy of the present invention has 0.05 to 1.5 wt % of iron and less than 0.4% of bismuth, so as to lower production cost, eliminate cracks and increase production yield.

8 Claims, 5 Drawing Sheets

LEAD-FREE BRASS ALLOY

BACKGROUND OF THE INVENTION

1. Field of the Invention

The present invention relates to a brass alloy and more particularly, to a lead-free brass alloy including less than 0.25 wt % of lead.

2. Description of Related Art

A brass includes copper and zinc, as major ingredients, usually in a ratio of about 7:3 or 6:4. In addition, a brass usually includes a small amount of impurities. In order to improve the properties of a brass, a conventional brass contains lead (mostly in the range of 1 to 3 wt %) to achieve the desired mechanical properties for use in the industry, thereby becoming an important industrial material that is widely applicable to metallic devices and valves for use in pipelines, faucets and water supply and discharge systems.

However, as awareness of the importance of environmental protection increases and the impact of heavy metals on human health becomes better understood, it is a trend to restrict the use of lead-containing alloys. Japan and the United States, have progressively amended relevant regulations in an intensive effort to lower the lead content in the environment by particularly requiring that no lead shall leach from lead-containing alloys used in products ranging from household appliances and automobiles to residential water pipes and municipal water systems, while also requiring that lead contamination shall be avoided during processing.

On the other hand, if the zinc content of brass exceeds 20 wt %, corrosion (such as dezincification) is likely to occur. Since dezincification seriously damages the structure of brass, the surface integrity of brass products is lowered and even pores may be formed in brass pipes. This significantly decreases the lifespan of brass products, thereby causing application problems.

In order to overcome the aforesaid high content of lead and dezincification, it is a trend to develop novel copper alloy formulations. For example, Taiwanese Patent No. 421674, U.S. Pat. No. 7,354,489, and US Patent Application Publication Nos. 20070062615, 20060078458, 2004023441 and 2002069942 disclose adding silicon (Si) and other elements to form lead-free copper alloys. However, the alloys made from these formulations have poor property for cutting. Chinese Patent Application Publication No. 10144045 discloses aluminum, silicon and phosphorous as main components of a lead-free copper alloy. This lead-free copper alloy can be used for casting, but has poor property for cutting and much lower processing efficiency than lead-containing brass. Chinese Patent Application Publication Nos. 101285138 and 101285137 disclose phosphorous-containing lead-free copper alloy; however, cracks are easily formed while casting this alloy.

In addition, U.S. Pat. Nos. 7,297,215, 6,974,509, 6,955,378, 6,149,739, 5,942,056, 5,637,160, 5,653,827, 5,487,867 and 5,330,712, and US Patent Application Publication Nos. 20060005901, 20040094243 and 20070039667 disclose lead-free or low-lead bismuth-containing brass alloy formulations, wherein the bismuth content of the formulations ranges from 0.5 wt % to 7 wt %; however, the high content of bismuth in the alloy causes cracks on the surface of the cast. Further, Chinese Patent Application Publication No. 101403056 discloses a lead-free brass alloy containing bismuth and manganese, but this alloy still has the drawbacks owing to the high content of bismuth. If the bismuth content is decreased and the manganese content is increased, the stiffness would be enhanced but the cutting property would be poor. Chinese Patent Application Publication No. 101440445 discloses an aluminum brass alloy having bismuth and zinc, wherein tin is also included for improving cutting property of the aluminum brass alloy; however, this alloy is not so applicable for subsequent processing owing to its hardness.

Therefore, there is a need to develop a formulation for forming an alloy having better corrosion resistance, casting property, cutting property and mechanical property.

SUMMARY OF THE INVENTION

The present invention provides a lead-free brass alloy, including 0.3 to 0.8 wt % of aluminum, 0.01 to 0.4 wt % of bismuth, 0.05 to 1.5 wt % of iron and more than 96 wt % of copper and zinc, wherein the copper is present in an amount ranging from 58 to 75 wt %. The brass alloy of the present invention meets the standard of the environmental regulation, wherein the lead content is less than 0.25 wt % based on the weight of the alloy. Further, iron is added and bismuth content is decreased in the brass alloy of the present invention, so as to lower production cost, eliminate cracks, have good casting property, mechanical strength, processibility and corrosion resistance, and efficiently increase production yield.

The present invention further provides a lead-free brass alloy, including 0.3 to 0.8 wt % of aluminum, 0.01 to 0.4 wt % of bismuth, 0.05 to 1.5 wt % of iron, 0.05 to 0.3 wt % of manganese and more than 96 wt % of copper and zinc, wherein the copper is present in an amount ranging from 58 to 75 wt %. The brass alloy of the present invention meets the standard of the environmental regulation, wherein the lead content is less than 0.25 wt % based on the weight of the alloy. Further, iron and manganese are added and bismuth content is decreased in the brass alloy of the present invention, so as to lower production cost, eliminate cracks, improve mechanical property and corrosion resistance to sea water, have good casting property, toughness, mechanical strength, processibility and corrosion resistance, and efficiently increase production yield.

The present invention further provides a lead-free brass alloy, including 0.3 to 0.8 wt % of aluminum, 0.01 to 0.4 wt % of bismuth, 0.05 to 1.5 wt % of iron, 0.05 to 0.3 wt % of manganese, 0.05 to 0.3 wt % of nickel and more than 96 wt % of copper and zinc, wherein the copper is present in an amount ranging from 58 to 75 wt %. The brass alloy of the present invention meets the standard of the environmental regulation, wherein the lead content is less than 0.25 wt % based on the weight of the alloy. Further, iron, manganese and nickel are added and bismuth content is decreased in the brass alloy of the present invention, so as to lower production cost, eliminate cracks, minimize granules of the brass alloy, improve mechanical property and corrosion resistance to sea water, have good casting property, toughness, mechanical strength, processibility and corrosion resistance, and efficiently increase production yield.

DETAILED DESCRIPTION OF THE PREFERRED EMBODIMENTS

Figure 1A:
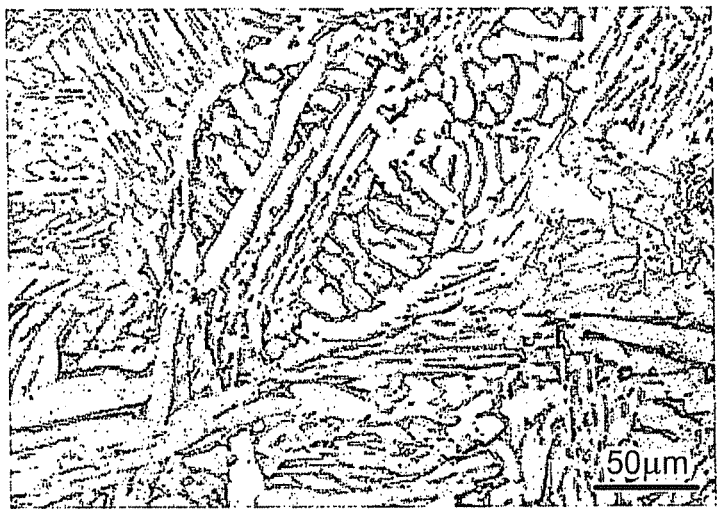
FIG. 1A shows a metallographic structural distribution of the lead-free brass alloy of the comparative sample 1.

The detailed description of the present invention is illustrated by the following specific examples. Persons skilled in the art can conceive the other advantages and effects of the present invention based on the disclosure contained in the specification of the present invention.

Unless otherwise specified, the ingredients comprised in the environmental friendly brass alloy of the present invention, as discussed herein, are all based on the total weight of the brass alloy, and are expressed in weight percentages (wt %).

In the lead-free brass alloy of the present invention, the content of copper and zinc is more than 96 wt % based on the total weight of the lead-free brass alloy, wherein the copper is present in an amount ranging from 58 to 75 wt %, and preferably in an amount ranging from 60.5 to 63 wt %, so as to provide roughness of the alloy and to facilitate the subsequent processing.

In the lead-free brass alloy of the present invention, aluminum is present in an amount ranging from 0.3 to 0.8 wt %, and preferably in an amount ranging from 0.5 to 0.65 wt %. The certain amount of aluminum is added in the brass alloy for improving the fluidity and casting property of the brass alloy.

Generally, in order to meet the environmental regulation, the lead content must be decreased in the alloy. Instead of lead, bismuth is usually added in the alloy to maintain the cutting property and to be nontoxic to human body and environment. Generally, 0.5 to 7 wt % of bismuth is added in the alloy to form low lead or lead-free brass alloy such as C85710 brass alloy.

In the ($\alpha$+$\beta$) biphase brass alloy, the bismuth film is present at the interface between $\alpha$ and $\beta$ so as to weaken the crystal boundary. It is proved by the experiment that the granular bismuth is increased along with the addition of bismuth in the brass alloy so as to decrease plasticity and extension of the brass alloy, such that cracks easily occur in the extension test. On the other hand, due to the addition of bismuth in the alloy, the granular bismuth is increased in the substrate, such that the dispersion of granules enforces the substrate and thus enhances the stiffness of the alloy.

The addition of bismuth in the lead brass alloy improves the cutting property of the substrate, but weakens the mechanical strength of the alloy and increases the hot shortness and cold shortness of the alloy, such that cracks easily occur while casting and the production yield is also decreased. Further, it is shown in the experiment that even the bismuth content in the brass alloy is decreased to 0.5 wt %, there is still the bismuth slipping film in the granule of the brass alloy. The continuous lamellar bismuth film is distributed in the granular boundary, so as to weaken the mechanical strength, increase the hot shortness and cold shortness and increase the occurrence of cracks. Therefore, in the lead-free brass alloy of the present invention, the bismuth content is present in an amount ranging from 0.01 to 0.4 wt %, and preferably in an amount ranging from 0.1 to 0.2 wt % based on the weight of the lead-free brass alloy.

In the lead-free brass alloy of the present invention, a certain amount of iron is added to overcome the aforesaid cracks in the bismuth brass alloy, and also to enhance the property of the brass alloy like cutting property of C85710 brass alloy. The micro iron granule is used as a crystal nucleus to raise the temperature at which granule and brass alloy are re-crystallized, to avoid the growth of granule, and further to enhance the mechanical property of the brass alloy. Thus, the iron brass alloy has toughness, wear resistance, and corrosion resistance to air and sea water, and is applicable to a component tolerant to friction and sea water corrosion. According to the experiment result, when the iron content in the brass alloy is less than 1.5 wt %, the brass alloy has the ($\alpha$+$\beta$) constitution, high strength, stiffness and good plasticity at either high or low temperature. When the iron content is more than 1.5 wt %, the $\alpha$ phase is extended and $\beta$ phase is reduced, such that the strength of the alloy is decreased, and fluidity, mechanical property and cutting property of the alloy are poor.

In the lead-free brass alloy of the preset invention, iron is present in an amount ranging form 0.05 to 1.5 wt %, preferably in an amount ranging from 0.1 to 1.5 wt %, and more preferably in an amount ranging from 0.2 to 1.5 wt %, such that the mechanical strength and toughness are increased. Also, the bismuth content is significantly decreased to eliminate cracks, such that the alloy has good casting property, mechanical property and polishing property. In addition, iron is non-toxic, non-harmful and non-pollutant, but essential element to human body. There is no restriction to iron content in the regulation. Therefore, the brass alloy of the present invention is applicable to faucets, components in bathrooms, water pipes, water supply systems, etc.

In the lead-free brass alloy of the preset invention, iron content is more than 0.05 wt %, preferably more then 0.1 wt %, and more preferably more than 0.2 wt %. In the lead-free brass alloy of the preset invention, the bismuth content is less than 0.4 wt %, and preferably less than 0.2 wt %. The brass alloy of the preset invention has good cutting property and meets lead requirement of the regulation (i.e. lead content in the brass alloy being less than 0.25 wt %, preferably less than 0.15 wt % and more preferably less than 0.05 wt %.)

In the lead-free brass alloy of the present invention, manganese is add in combination with at least 0.05 wt %, preferably at least 0.1 wt % and more preferably at least 0.2 wt %, of iron. According to the experiment result, manganese and copper form continuous solid solution, expand $\alpha$ phase, and raise the temperature of re-crystallization. Thus, the alloy and iron form finer granules, so as to improve strength, roughness, mechanical property and corrosion resistance to air and sea water, and to eliminate hard alloy and cracks. In one embodiment, the lead-free brass alloy of the present invention includes 0.05 to 0.3 wt % of manganese. Preferably, the lead-free brass alloy of the present invention includes 0.1 to 0.2 wt % of manganese.

Furthermore, nickel can be added in the lead-free brass alloy of the present invention, to minimize the alloy granules, and to improve mechanical strength and corrosion resistance to sea water. It is found that manganese and nickel increase the strength and toughness of the brass alloy, and improve the corrosion resistance to air and sea water. According to the metallographic structural distribution, while adding manganese and nickel in the lead-free brass alloy, α phase turns into long plate shape, such that the alloy has better plasticity and toughness. Further, since manganese, nickel and copper form continuous solid solution for expanding α phase, the temperature of re-crystallization is raised to form finer granules made of brass alloy and iron, so as to eliminate hard alloy and cracks. In one embodiment, the lead-free brass alloy includes 0.05 to 0.3 wt % of nickel. Preferably, the lead-free brass alloy includes 0.1 to 0.25 wt % of nickel.

Embodiments

Casting was performed by using the metal gravity casting machine to test the brass alloys having different elements with different ratios. In the test, casting molds, sand core granules, stiffness, resin and curing agents were kept constant. Each element was added into the furnace. After the brass alloy became molten (referred as molten copper solution hereafter), the elements of the molten copper solution were examined by spectrophotometer. The temperature of the molten copper solution was kept at 1030 to 1050° C., and the temperature of mold tools was kept at 150 to 170° C.

Casting was performed by using the metal gravity casting machine. 1 to 2 kg of materials were introduced, the casting was performed for 3 to 5 seconds, cooling time for the mold tools was controlled, and then the mold release was performed upon solidification of the cast. After the cast was taken out, the mold tools were cleaned to keep the core clean. The mold tools were sprayed with aqueous graphite, and then immersed into water for cooling. The temperature of the aqueous graphite was 32 to 38° C., and the specific density of the aqueous graphite was 1.05 to 1.06.

The cooled cast was examined and cleaned. Then, the as-cast treatment and the heat treatment were performed to eliminate the internal stress. Subsequently, mechanical processing and polishing were performed on the cast to remove the sand core, metal debris and impurities in the cast. The samples upon casting, mechanical processing and polishing were analyzed, and the overall production yield was calculated.

$$\text{Overall Production Yield} = \text{Number of Non-Defective Products}/\text{Total Number of Products} \times 100\%$$

The overall production yield reflects the qualitative stability of production processes. High qualitative stability of production processes ensures normal production.

Comparative Example 1

The analysis data and the overall production yield of the comparative sample 1 are shown in Table 1.

Figure 1B:
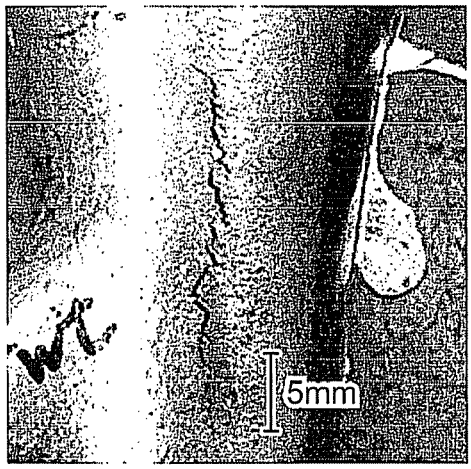
FIG. 1B shows the surface of the cast of the lead-free brass alloy of the comparative sample 1.
Figure 1C:
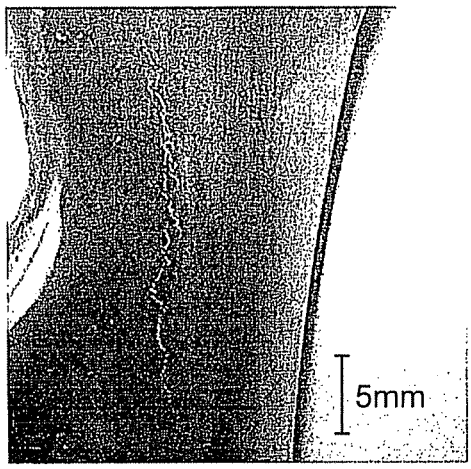
FIG. 1C shows the surface of the cast of the lead-free brass alloy of the comparative sample 1 after polishing.

The metallographic structural distribution of the lead-free brass alloy of the comparative sample 1 is shown in FIG. 1A. It is shown that the granule of the comparative sample 1 has thin strip shape, and the granule size is about 45 to 55 micrometers. As shown in FIG. 1B, the comparative sample 1 has poor toughness, and there are cracks on the surface of the cast. After polishing, there are still cracks having obvious depth, as shown in FIG. 1C.

Example 1

The analysis data and the overall production yield of the lead-free brass alloy of the sample 1 in the present invention are shown in Table 1.

Figure 2A:
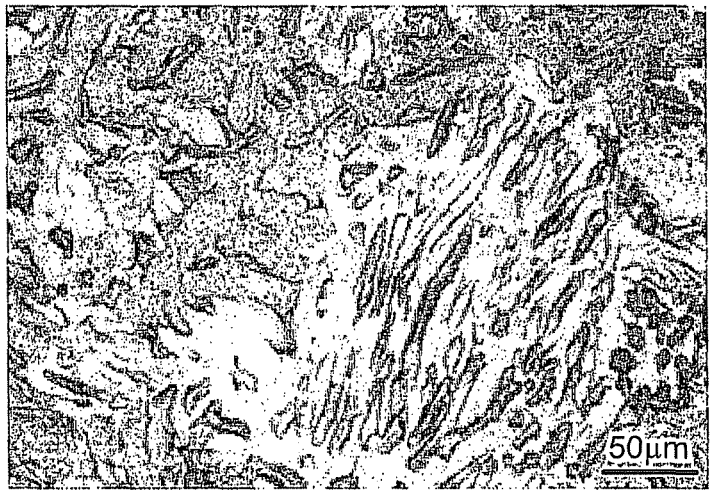
FIG. 2A shows a metallographic structural distribution of the lead-free brass alloy of the sample 1 according to the present invention.
Figure 2B:
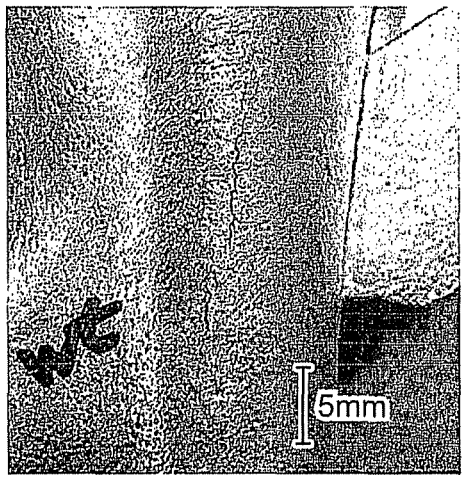
FIG. 2B shows the surface of the cast of the lead-free brass alloy of the sample 1 according to the present invention.
Figure 2C:
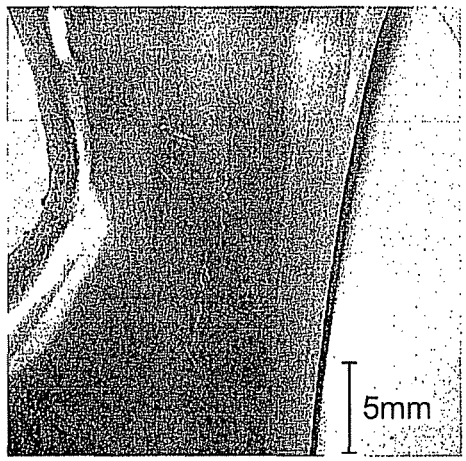
FIG. 2C shows the surface of the cast of the lead-free brass alloy of the sample 1 after polishing according to the present invention.

The metallographic structural distribution of the lead-free brass alloy of the sample 1 in the present invention is shown in FIG. 2A. The granule of the sample 1 has thin strip shape, and the granule size is about 40 to 50 micrometers. In comparison with Comparative Example 1, the iron content in the brass alloy of the present invention is increased to 0.094 wt %, so as to improve the roughness of the brass alloy. As shown in FIG. 2B, the cracks on the cast are thin. Referring to FIG. 2C, after polishing, the cracks on the cast are not obvious.

Example 2

Similarly, according to the elements shown in Table 1, the iron content in the alloy is increased to 0.613 wt % in combination with 0.158 wt % of manganese so as to form the lead-free brass alloy of the sample 2 of the present invention. The analysis data and the overall production yield of the lead-free brass alloy of the sample 2 in the present invention are shown in Table 1.

Figure 3A:
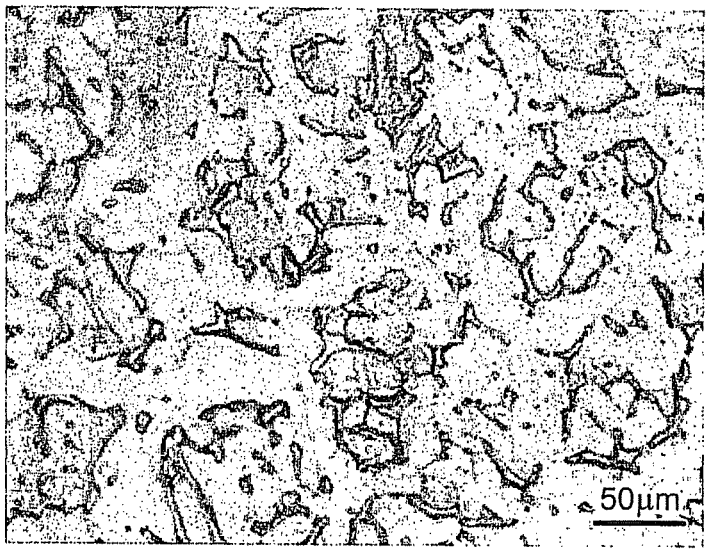
FIG. 3A shows a metallographic structural distribution of the lead-free brass alloy of the sample 2 according to the present invention.
Figure 3B:
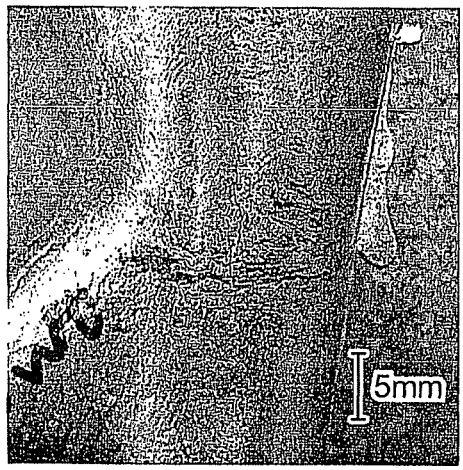
FIG. 3B shows the surface of the cast of the lead-free brass alloy of the sample 2 according to the present invention.
Figure 3C:
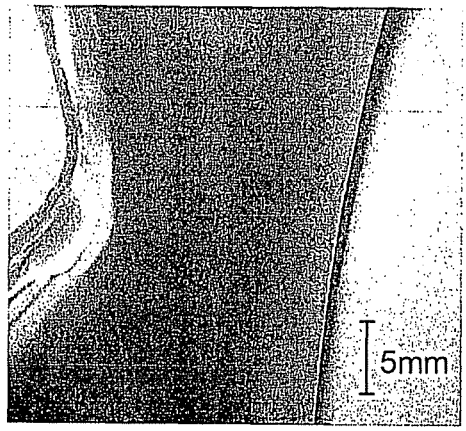
FIG. 3C shows the surface of the cast of the lead-free brass alloy of the sample 2 after polishing according to the present invention.

The metallographic structural distribution of the lead-free brass alloy of the sample 2 in the present invention is shown in FIG. 3A. In comparison with the sample 1, the granules of the sample 2 are thinner and smaller, and the granule size is about 35 to 40 micrometers. The sample 2 has better toughness. As shown in FIG. 3B, the cast has no obvious cracks. As shown in FIG. 3C, after polishing, there is almost no crack on the surface of the cast.

Example 3

Similarly, according to the elements shown in Table 1, the iron content in the alloy is increased to 1.12 wt % in combination with manganese and nickel so as to form the lead-free brass alloy of the sample 3 in the present invention. The analysis data and the overall production yield of the lead-free brass alloy of the sample 3 in the present invention are shown in Table 1.

Figure 4A:
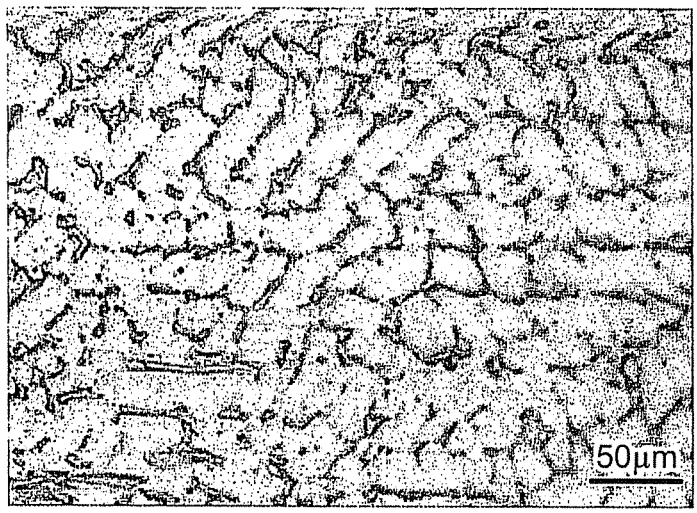
FIG. 4A shows a metallographic structural distribution of the lead-free brass alloy of the sample 3 according to the present invention.
Figure 4B:
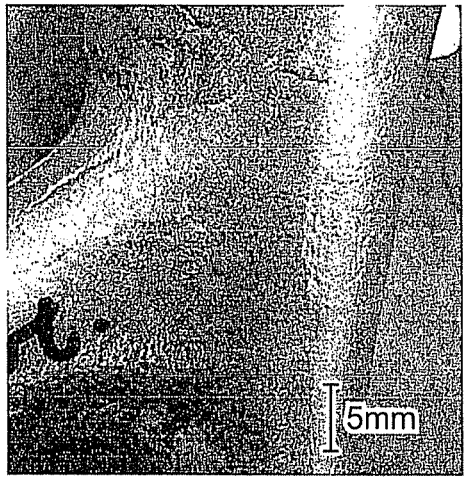
FIG. 4B shows the surface of the cast of the lead-free brass alloy of the sample 3 according to the present invention.
Figure 4C:
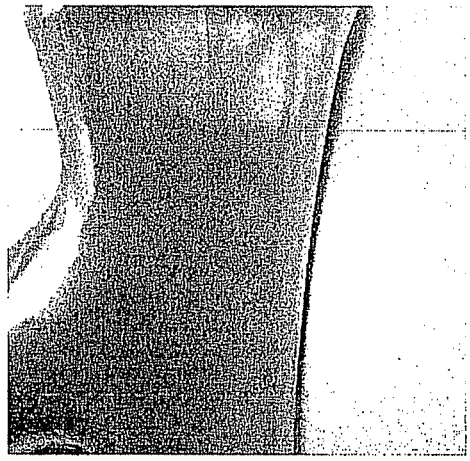
FIG. 4C shows the surface of the cast of the lead-free brass alloy of the sample 3 after polishing according to the present invention.

The metallographic structural distribution of the lead-free brass alloy of the sample 3 in the present invention is shown in FIG. 4A. The granules of the sample 3 are nearly round, and the granule size is about 30 to 40 micrometers. In comparison with Examples 1 and 2, the lead-free brass alloy of the sample 3 has much finer and more condenses granules, and has excellent toughness. As shown in FIG. 4B, there is no crack on the surface of the cast. As shown in FIG. 4C, after polishing, the surface is so smooth. Moreover, the yield of casting is more than 90%.

Control Examples 1 and 2

The steps were similar to those in Example 1. According to the elements shown in Table 1, the high tin lead-free brass alloy of the control samples 1 and 2 were obtained. The analysis data and the overall production yield of the control samples 1 and 2 are shown in Table 1.

Figure 5:
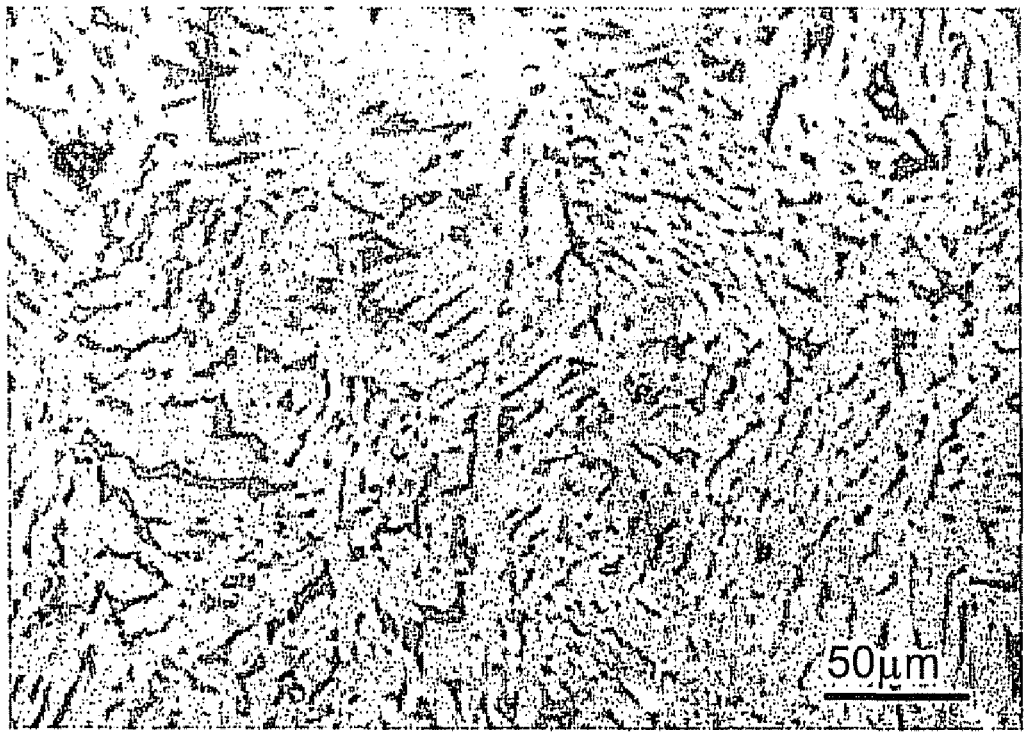
FIG. 5 shows a metallographic structural distribution of the high tin lead-free brass alloy of the control sample 1 according to the present invention.

The metallographic structural distribution of the control sample 1 is shown in FIG. 5. The granules have long strip shape, and have high stiffness and brittle. However, cracks easily occur while casting, and thus defects are easily formed in subsequent processing.

Control Examples 3 and 4

The steps were similar to those in Example 1. According to the elements shown in Table 1, the C85710 brass alloys of the control samples 3 and 4 were obtained. The analysis data and the overall production yield of the control samples 3 and 4 are shown in Table 1.

The metallographic structural distribution of the C85710 brass alloy shows that the granules are round, and the granule size is about 30 to 40 micrometers. The C85710 brass alloy is α phase alloy and has good roughness.

alloys of the control samples 1 and 2 need more cutting force and consume more cutting tools during mechanical processing. In the polishing process, pocks easily occur on the surface of the high tin lead-free brass alloys of the control samples 1 and 2 so as to increase product cost and decrease production efficiency.

In contrast, the total production yield of the lead-free brass alloy of the present invention is more than 70%, and even more than 82%. The lead-free brass alloy of the present invention has the casting property and the cutting property comparable to those of the conventional C85710 brass alloy. Hence, the conventional C85710 brass alloy can be replaced with the lead-free brass alloy of the present invention. In addition, the lead content is significantly decreased in the lead-free brass

TABLE 1

| | High tin lead-free brass alloy | | C85710 brass alloy | | Lead-free brass alloy | | | |
|---|---|---|---|---|---|---|---|---|
| | Control Example 1 | Control Example 2 | Control Example 3 | Control Example 4 | Comparative Example 1 | Example 1 | Example 2 | Example 3 |
| Cu content (wt % ) | 62.54 | 62.79 | 59.81 | 60.05 | 62.93 | 62.84 | 62.43 | 62.12 |
| Al content (wt % ) | 0.584 | 0.541 | 0.524 | 0.532 | 0.515 | 0.535 | 0.572 | 0.562 |
| Pb content (wt % ) | 0.012 | 0.009 | 1.76 | 1.69 | 0.023 | 0.021 | 0.032 | 0.025 |
| Bi content (wt % ) | 0.143 | 0.158 | 0.0072 | 0.0069 | 0.151 | 0.149 | 0.173 | 0.153 |
| Zn content (wt % ) | in balance | in balance | in balance | in balance | in balance | in balance | in balance | in balance |
| Sn content (wt % ) | 0.873 | 0.798 | 0.011 | 0.009 | 0.023 | 0.029 | 0.026 | 0.024 |
| Mn content (wt % ) | 0.002 | 0.001 | 0.002 | 0.001 | 0.003 | 0.166 | 0.158 | 0.162 |
| Ni content (wt % ) | 0.031 | 0.023 | 0.087 | 0.082 | 0.061 | 0.162 | 0.155 | 0.157 |
| Fe content (wt % ) | 0.016 | 0.013 | 0.025 | 0.029 | 0.024 | 0.094 | 0.613 | 1.12 |
| Yield of casting | 89% | 88% | 93% | 94% | 83% | 87% | 89% | 91% |
| Yield of mechanical processing | 88% | 89% | 98% | 97% | 88% | 88% | 91% | 95% |
| Yield of polishing | 90% | 91% | 96% | 9% | 95% | 96% | 95% | 96% |
| Total production yield | 70.4% | 71.2% | 87.4% | 86.6% | 69.3% | 73.4% | 76.9% | 82.9% |

According to the experiment result, although the high tin lead-free brass alloys of Control Examples 1 and 2 have thermal resistance and corrosion resistance, solid-solution strengthening is formed once tin is dissolved in the solid solution of copper substrate. In the brass alloy, as the tin content is increased, r phase (CuZnSn compound) with brittle occurs in the alloy, which is disadvantage to the plastic processing of the alloy, and furthermore the occurrence of cracks during casting cannot be well controlled.

The high tin lead-free brass alloy has high brittle, and is hard to be polished. In comparison with the lead-free brass alloy of the present invention, the high tin lead-free brass alloy of the present invention, so as to avoid the lead pollution, and to eliminate lead precipitation while casting. Therefore, the lead-free brass alloy of the present invention meets the requirements of the environmental regulation.

Test Example 1

The tests on the mechanical properties of the brass alloys in Example 3 and Control Example 1 were performed according to the standard set forth in ISO6998-1998, "Tensile experiments on metallic materials at room temperature." The results are shown in Table 2.

TABLE 2

| | Mechanical properties | | | | | | | | | | | | | | | | | |
|---|---|---|---|---|---|---|---|---|---|---|---|---|---|---|---|---|---|---|
| | Tensile Strength (Mpa) | | | | | | Elongation (%) | | | | | | Stiffness (HRB) | | | | | |
| | 1 | 2 | 3 | 4 | 5 | Avg. | 1 | 2 | 3 | 4 | 5 | Avg. | 1 | 2 | 3 | 4 | 5 | Avg. |
| Example 3 | 373 | 385 | 379 | 368 | 372 | 375.4 | 15.4 | 14.8 | 16.2 | 14.5 | 15.6 | 15.3 | 59 | 55 | 68 | 63 | 66 | 62.2 |
| Control Example 1 | 382 | 391 | 388 | 396 | 392 | 389.8 | 12.2 | 13.6 | 13.2 | 12.9 | 11.7 | 12.7 | 69 | 72 | 71 | 68 | 76 | 71.2 |

As shown in Table 2, the lead-free brass alloy of the present invention (Example 3) has the elongation significantly better than the high tin lead-free brass alloy (Control Example 1). It is clear that the lead-free brass alloy of the present invention has excellent roughness and plasticity. The high tin lead-free brass alloy of Control Example 1 has higher brittle and tensile strength, such that the subsequent processing is difficult, and production cost is increased. In comparison with the high tin lead-free brass alloy, the lead-free brass alloy of the present invention is indeed better for subsequent production.

Test Example 2

The tests were performed according to the standard set forth in NSF 61-2007a SPAC for the allowable precipitation amounts of metals in products, to examine the amounts of the metal precipitations of the lead-free brass alloy (Example 3) and the C85710 brass alloy (Control Example 3) in an aqueous environment.

The iron included in the lead-free brass alloy of the present invention is not harmful to human body, so as to meet the regulations. The results are shown in Table 3.

TABLE 3

| Element | Upper Limit of Standard Value (μg/L) | C85710 brass alloy | C85710 brass alloy (after a lead-stripping treatment) | Example 3 |
|---|---|---|---|---|
| Pb | 5.0 | 16.454 | 0.772 | 0.252 |
| Bi | 50.0 | 0.008 | 0.006 | 0.029 |
| Al | 5.0 | 0.085 | 0.052 | 0.116 |
| Ni | 20.0 | 0.029 | 0.018 | 0.035 |

The C85710 brass alloy without the lead-stripping treatment has the lead content much over the standard. In contrast, the lead-free brass alloy (Example 3) of the present invention without lead-stripping treatment meets the standard. Further, the lead precipitation of the lead-free brass alloy of the present invention is significantly less than the C85710 brass alloy with the lead-stripping treatment. It is thus clear that the lead-free brass alloy of the present invention meets the environmental regulation and is better for human health.

Accordingly, the lead-free brass alloy of the present invention has fine granular structure, good strength and toughness, so as to avoid cracks and to facilitate subsequent processing. Therefore, the lead-free brass alloy of the present invention has the material properties of the lead brass alloy. In addition, the lead-free brass alloy of the present invention has low lead precipitation without the lead-stripping treatment, so as to lower production cost and to be applicable to industry.

The invention has been described using exemplary preferred embodiments. However, it is to be understood that the scope of the invention is not limited to the disclosed arrangements. The scope of the claims, therefore, should be accorded the broadest interpretation, so as to encompass all such modifications and similar arrangements.

The invention claimed is:

1. A lead-free brass alloy, consisting of:
0.3 to 0.8 wt % of aluminum;
0.01 to 0.4 wt % of bismuth;
0.05 to 1.5 wt % of iron;
0.05 to 0.3 wt % of nickel;
0.05 to 0.3 wt % of manganese; and
more than 96 wt % of copper and zinc, wherein the copper is present in an amount ranging from 58 to 75 wt %,
wherein the lead-free brass alloy comprises less than 0.25% of lead, and wherein the lead-free brass alloy is formed by casting and heat treatment for eliminating internal stress.

2. The lead-free brass alloy of claim 1, wherein the copper is present in an amount ranging from 60.5 to 63 wt %.

3. The lead-free brass alloy of claim 1, wherein the aluminum is present in an amount ranging from 0.5 to 0.65 wt %.

4. The lead-free brass alloy of claim 1, wherein the bismuth is present in an amount ranging from 0.1 to 0.2 wt %.

5. The lead-free brass alloy of claim 1, wherein the iron is present in an amount ranging from 0.1 to 1.5 wt %.

6. The lead-free brass alloy of claim 1, wherein the iron is present in an amount ranging from 0.2 to 1.5 wt %.

7. The lead-free brass alloy of claim 1, wherein the nickel is present in an amount ranging from 0.1 to 0.25 wt %.

8. The lead-free brass alloy of claim 1, wherein the manganese is present in an amount ranging from 0.1 to 0.2 wt %.

* * * * *